United States Patent [19]

von Laar et al.

[11] Patent Number: 4,660,458

[45] Date of Patent: Apr. 28, 1987

[54] PIVOTING PROJECTILE LOADING CHAMBER FOR HIGH ANGLE-FIRING WEAPONS

[75] Inventors: Klaus von Laar, Lauf/Pegn.; Werner Heberlein, Nuremberg; Cavit Winter, Schnaittach, all of Fed. Rep. of Germany

[73] Assignee: Diehl GmbH & Co., Nuremberg, Fed. Rep. of Germany

[21] Appl. No.: 742,738

[22] Filed: Jun. 10, 1985

[30] Foreign Application Priority Data

Jun. 30, 1984 [DE] Fed. Rep. of Germany ..... 3424215

[51] Int. Cl.[4] ..... F41F 11/00; F41F 13/02

[52] U.S. Cl. ..... 89/25; 89/26; 89/33.03; 89/37.05; 89/27.11

[58] Field of Search ..... 89/25, 26, 163, 164, 89/172, 27.11, 37.05, 40.02, 33.03; 42/8, 12

[56] References Cited

U.S. PATENT DOCUMENTS 35,863 7/1862 Moffatt ..... 89/25

3,768,362 10/1973 Grimm et al. ..... 89/26

FOREIGN PATENT DOCUMENTS 73513 of 1944 Czechoslovakia ..... 89/25

684146 11/1939 Fed. Rep. of Germany ..... 89/25

*Primary Examiner*—Deborah L. Kyle

*Assistant Examiner*—Michael J. Carone

*Attorney, Agent, or Firm*—Scully, Scott, Murphy & Presser

[57] ABSTRACT

A pivoting or swivable projectile or shell loading chamber for high angle-firing weapons, especially for mortars, which is constructed so as to be barrel-shaped at its lower end and which support itself on the base plate of the mortar, and which can be swung with its upper end outwardly of a position extending coaxially with the weapon firing tube. The upper separating location between the firing tube and the pivoting projectile loading chamber is sealed through a gas pressure-controlled sealing ring. A locking lever is arranged in the upper region of the pivoting projectile loading chamber, which is in operative connection with locking components on the framework of the mortar and with trigger parts of the mortar, and wherein the opening angle of the pivoting projectile loading chamber is restricted by a stop.

9 Claims, 9 Drawing Figures

4
39
8
1
2

PIVOTING PROJECTILE LOADING CHAMBER FOR HIGH ANGLE-FIRING WEAPONS

BACKGROUND OF THE INVENTION

1. Field of the Invention

The present invention relates to a pivoting or swivable projectile or shell loading chamber for high angle-firing weapons, especially for mortars, which is constructed so as to be barrel-shaped at its lower end and which support itself on the base plate of the mortar, and which can be swung with its upper end outwardly of a position extending coaxially with the weapon firing tube.

2. Discussion of the Prior Art

A pivoting projectile loading chamber of the type under consideration is already known from the disclosure of Czechoslovakian Pat. No. 73 513. In that particular disclosure, referring especially to the drawings thereof, there can be ascertained that a projectile chamber which is located in the lower region of the high angle-firing weapon or mortar is pivotable about a lower point of rotation or fulcrum from a position which extends coaxially with the firing tube into a limited opening angle. However, it is impossible to ascertain from the disclosure of this Czechoslovakian patent, the manner in which the swivel projectile loading chamber can be sealed at its end surface facing the weapon barrel or firing tube. Furthermore, there cannot be recognized the manner in which the swivel projectile loading chamber is locked in the inwardly pivoted or aligned position, and the manner in which there is to be implemented the triggering of a shot at the inwardly pivoted projectile loading chamber.

SUMMARY OF THE INVENTION

Accordingly, commencing from the known state of the art, it is an object of the present invention to achieve in a pivoting projectile loading chamber of the above mentioned type, an adequate degree of sealing at the separating location between the firing tube and pivoting projectile loading chamber, and to thereby further afford and ensure a locking of the pivoting projectile loading chamber within the framework of the mortar; and to thereby render possible the firing of a shot only in the locked position of the pivoting projectile loading chamber in a position coaxially with the weapon barrel or firing tube.

The foregoing object is inventively attained in that the upper separating location between the firing tube and the pivoting projectile loading chamber is sealed through a gas pressure-controlled sealing ring, in that a locking lever is arranged in the upper region of the pivoting projectile loading chamber, which is in operative connection with locking components on the framework of the mortar and with trigger parts of the mortar, and wherein the opening angle of the pivoting projectile loading chamber is restricted by a stop. Hereby, the sealing ring can be inserted into an axial annular groove provided in the separating plane of the pivoting projectile loading chamber, and through the intermediary of bores formed in the wall of the pivoting projectile loading chamber stand in communication with the interior space thereof, and in the locked position stand the pressure of propellant gases during the firing of the projectile. In this mode and manner is there afforded by the inventive arrangement an assured sealing between the pivoting projectile loading chamber and the firing tube during the triggering of a shot.

Furthermore, the locking lever can be constructed as a double lever and pivotably mounted on the projectile loading chamber, and possesses an angled or bent end towards the equipment, whose outer side, at an opened pivoting projectile loading chamber, will stand on the inner curve of the locking component which is fixed to the framework, whereas the inner side, at a closed pivoting projectile loading chamber, will lie against the outer curve of the locking component which is fixed to the framework. Achieved hereby, on the one hand, is that the pivoting projectile loading chamber is secured in the outwardly pivoted position against any inadvertent inward pivoting, inasmuch as, on the other hand, it can be securely locked in the inwardly pivoted position for the firing of a shot. Another type of construction consists of in that the locking lever incorporates a projection at its end facing towards the equipment, which, when the pivoting projectile loading chamber is closed, will engage into the groove of the locking component which is fixed to the framework.

In order to especially facilitate the firing of a shot only in the locking position of the pivoting projectile loading chamber, the trigger lever can be arranged in the lower region of the pivoting projectile loading chamber spatially separated from the locking lever, and be actuatable only in dependence upon the locked position of the locking lever, and to move a striker member against the firing pin through the rotation of the trigger shaft. In another embodiment of this safety device, the trigger lever can be in the shape of a rod which is directly connected with the locking lever, with a lever being arranged at the end thereof which, in response to the rotation of the trigger shaft, moves a striker member against the firing pin. In this instance, the rod can be articulatedly connected with the locking lever, and include a projection which will release the rod from a stop or catch fixed to the framework only under a fully closed and locked condition. Only in this fully locked position of the pivoting projectile loading chamber can the rod be moved essentially axially outside of the stop or catch, and thereby finally allow the striker member to move towards the firing pin.

Pursuant to a further modification of the invention, a follower can be supported secured against rotation on the trigger shaft which, by means of a lever, pivots a rotatable striker member outwardly, which member stands under the action of a spring, and which upon release from the sharp edge of the follower will strike back against the firing pin. In order to totally block the firing or trigger lever in the outwardly pivoted or swung loading position, and to thereby avoid an undesirable triggering of a shot, in one embodiment of the invention there is provided a downwardly extended projection on the follower which, upon actuation of the trigger lever, will come into contact with a locking pin in the base member of the mortar. When the projectile loading chamber is unlatched by means of the locking lever and it pivots upwardly, then the locking pin by means of its projection will prevent the follower with the trigger shaft from rotating back, and again bring the follower or the trigger lever into its initial position opposite the projectile loading chamber. In order to avoid misfirings during the loading of shells or projectiles into the pivoting projectile loading chamber, the firing pin can be mechanically positively or forcibly controlled, in that a latch which is swung back by the follower will guide an attached projection into a groove in the firing pin, and draw the firing pin back from the detonating position. The firing pin can be centrally introduced into a closure screw which is inserted in the base of the pivoting projectile loading chamber, and thus renders easier the disassembling of the firing pin for servicing and cleaning purposes.

By means of a mortar system with a pivoting projectile loading chamber of the inventively proposed type, there can be realized an increase in the firing range of projectiles through the elongation of the firing tube, without thereby rendering more difficult the loading of the projectile loading chamber with projectiles. Furthermore, in an advantageous manner there is avoided any gas feedback, such as is encountered in front loaders, to allow for a more rapid insertion of projectiles. The firing tube or barrel can be also essentially constructed with the same size of caliber as that of the projectile. A mortar system with the inventive pivoting projectile loading chamber is imparted with the advantages that a loading of the high angle-firing weapon can be carried out under protection, the raising height for the projectile which are to be inserted, and thereby the necessary physical demands on the operating personnel are considerably reduced, and any double loading is basically precluded. Because of the lengthier firing tube which is facilitated by the pivoting projectile loading chamber, there can be reduced the gas pressure at the muzzle and the projectile energy increased. The partition of the firing tube further prevents the flowback of heat into the pivoting projectile loading chamber.

BRIEF DESCRIPTION OF THE DRAWINGS

Reference may now be had to the following detailed description of the exemplary embodiments of the invention, taken in conjunction with the accompanying drawings; in which.

DETAILED DESCRIPTION

Figure 1:
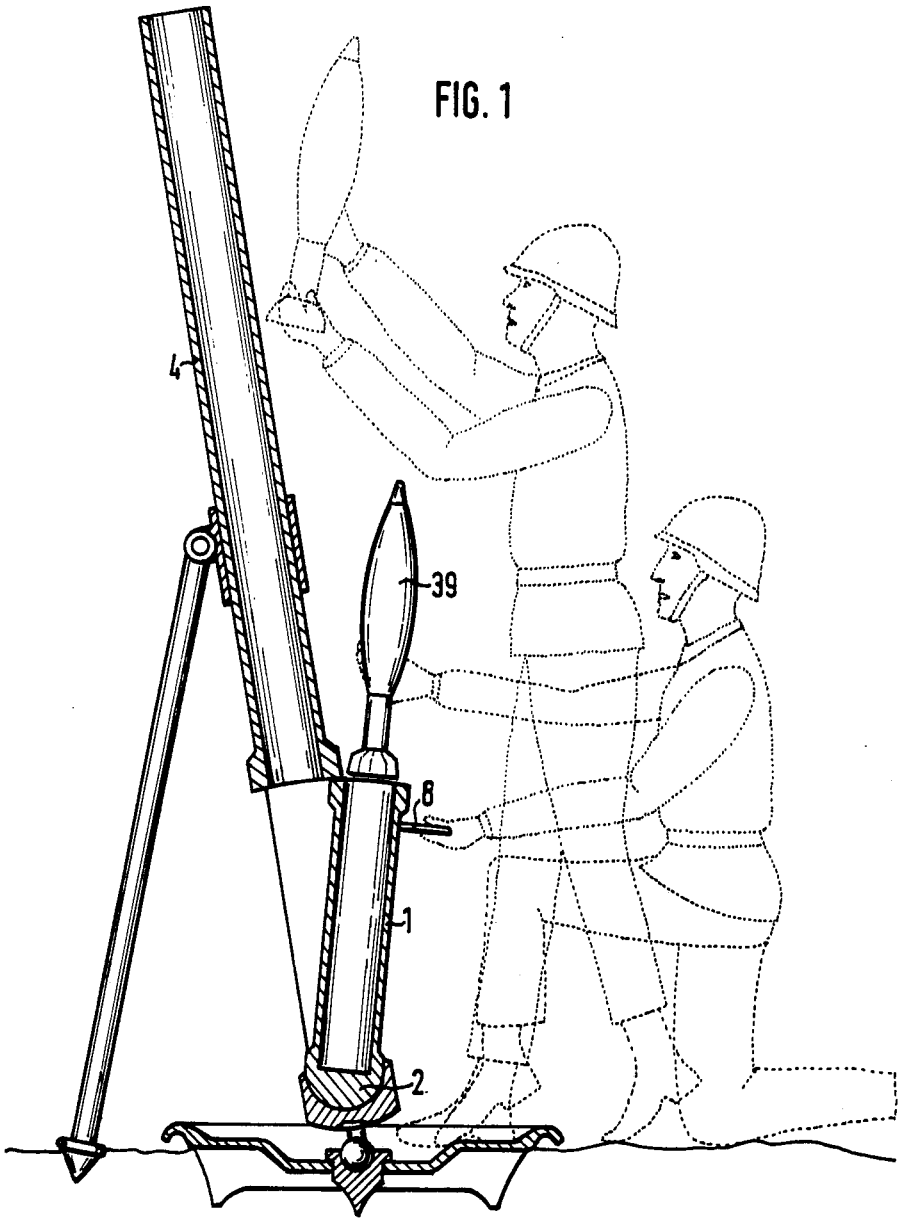
FIG. 1 illustrates a simplified longitudinal view through a mortar with a pivoting projectile loading chamber, shown in a demonstration of the loading sequence.
Figure 2:
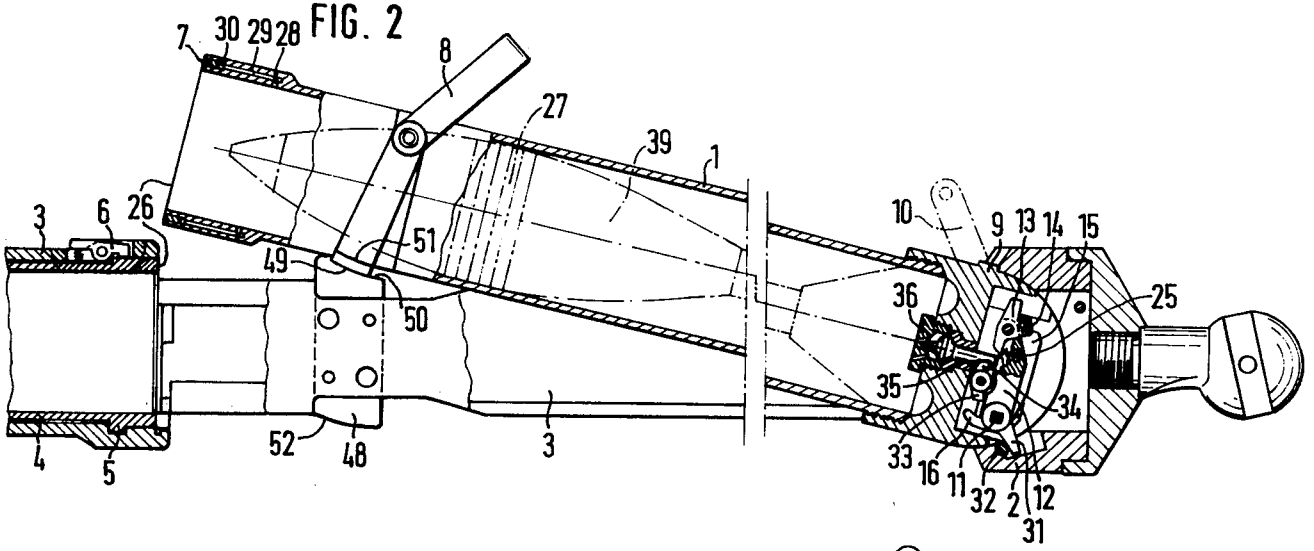
FIG. 2 illustrates a sectional view taken along line II—II in FIG. 7 through a pivoting projectile loading chamber in its opened loading position.
Figure 4:
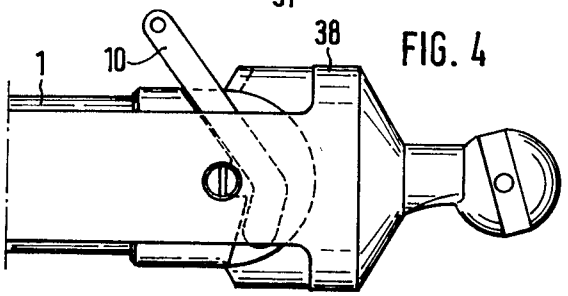
FIG. 4 illustrates a plan view of the trigger lever in the lower region of the pivoting projectile loading chamber.
Figure 3:
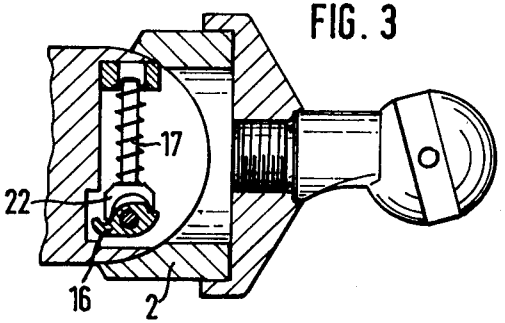
FIG. 3 illustrates a sectional view through the base member of the pivoting projectile loading chamber taken along line III—III in FIG. 7.
Figure 5:
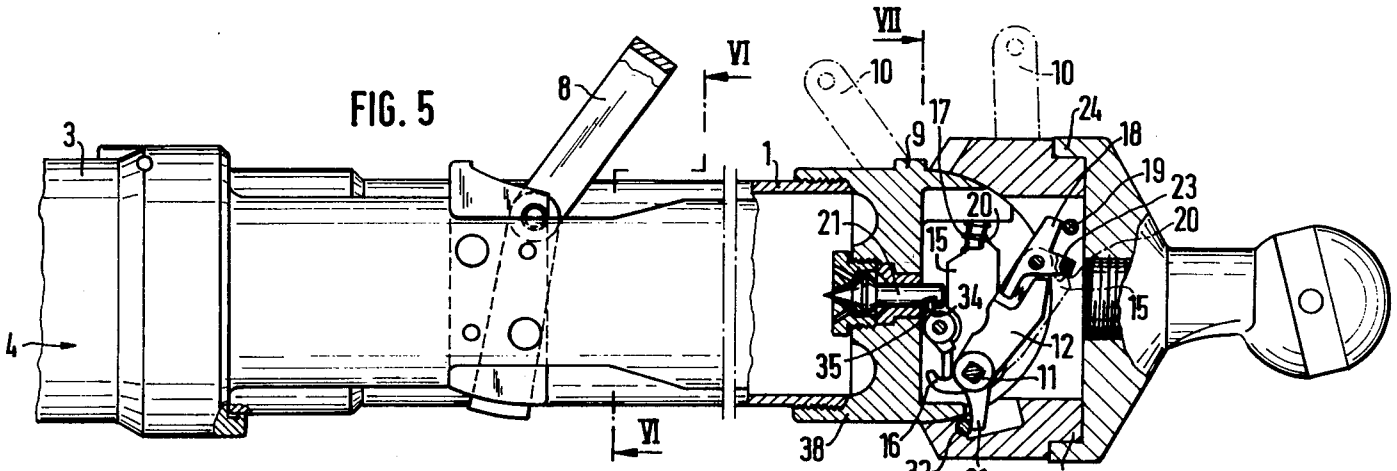
FIG. 5 illustrates a plan view of the pivoting projectile loading chamber in a closed position, shown partly in section, taken in the direction of arrow V in FIG. 7.
Figure 6:
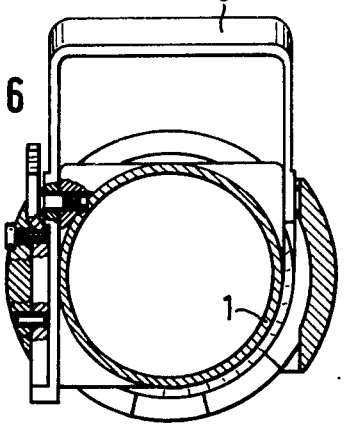
FIG. 6 illustrates a sectional view through the pivoting projectile loading chamber taken along line VI—VI in FIG. 5.
Figure 7:
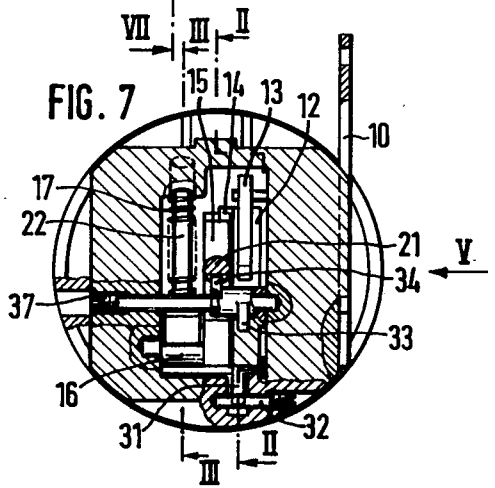
FIG. 7 illustrates a sectional view through the pivoting projectile loading chamber taken along line VII—VII in FIG. 5.

The pivoting or swivable projectile loading chamber 1 is constructed cylindrically-shaped at its lower end and supports itself on the base section 2 of the framework 3. The weapon barrel or firing tube 4 is connected through a bayonet closure 5 with the framework 3, and is secured against rotation through tube retaining latch 6. The sealing between the firing tube 4 and the pivoting projectile loading chamber 1 is provided by a gas pressure-controlled sealing ring 7.

By means of a locking lever 8 there is carried out the opening and closing of the projectile loading chamber and the precise alignment between the firing tube 4 and the pivoting projectile loading chamber 1, and further prevented that the pivoting projectile loading chamber 1 will by itself, subsequent to opening, again swing back into the position in parallel with the tube. Through a limit stop 9 is there prevented upon opening of the pivoting projectile loading chamber an undesirably wide opening angle.

In order to initiate the firing of a shot, the firing or trigger lever 10 is pressed downwardly. As a result, the trigger shaft 11 is rotated and the follower 12 is pivoted downwardly. A lever 13, which is rotatably supported on the leading end of the follower 12, takes along a rotatable striker member 15 due to the presence of a laterally protruding projection 14, and tensions a spring 17 by means of an extension 16 which is provided on the striker member 15. When the arm 18 of the lever 13 has reached the stop 19, it is then so pivoted upon the further rotation of the follower, that the projection 19 will slip off from the sharp edge 20 on the rotatable striker member 15 and thereby release the striker number 15. During its untensioning, the spring 17 accelerates the striker member 15 which strikes against the firing pin 21 and thereby initiates the firing. By means of the second projection on the pressure member 22, the striker member 15 is pivoted back into its initial start position. During the pivoting back of the follower 12, the projection 14 on the lever 13 slides over the inclines 23 and 24 past the sharp edge 20 on the striker member 5, and is again rotated by the spring 25 after sliding off from the sharp edge 20 into the initial position.

After the insertion of a projectile 39 into the pivoting projectile loading chamber 1, the locking lever 8 is pivoted upwardly. As a result, there is released the latching of the pivoting projectile loading chamber 1, and the latter slides practically under its own weight into the position which is coaxial with the weapon barrel or the firing tube 4. In this position the locking lever 8 is pivoted downwardly, such that the portion of the lever towards the equipment lies with its surface 51 against the arcuately-shaped curve 52 of the locking component 48. The weapon is thereby ready for firing.

After the actuation of the firing or trigger lever 10, the projection 31 of the follower 12 comes into contact against the locking pin 32. When the pivoting projectile loading chamber 1 is now unlatched by the locking lever 8 and pivoted upwardly, then the locking pin 32, by means of the projection 31, will hinder the follower 12 with the trigger shaft 11 from rotating back and will bring the follower 12 or the trigger lever 10 opposite the pivoting projectile loading chamber into the initial start position. The pivoting projectile loading chamber now is ready to be loaded. In this position, the trigger lever 10 is totally blocked. When the loaded pivoting projectile loading chamber 1 now is again brought into the position in which it is coaxial with the firing tube 4 and is latched by means of the locking lever 8 with the locking component 48, then the high angle-firing weapon is again ready for firing.

In order to avoid misfirings during the loading of the pivoting projectile loading chamber 1, the firing pin 21 is mechanically forcibly controlled. When the pivoting projectile loading chamber 1 is pivoted outwardly subsequent to the firing, then the pivoting back follower 12 will rotate the latch 33 in a clockwise direction. The displaced projection 34 of the latch 33, which is arranged in the groove of the firing pin 35, brings the firing pin 21 into the initial position.

The necessarily precise sealing of the separating location 26 between the firing tube 4 and the pivoting projectile loading chamber is provided by the gas pressure-controlled sealing ring 7. When the labyrinth seal 27 of the projectile 39 has passed the bores 28, then propellant gas flows through the bypass bores 29 into the space 30 behind the sealing ring 7 and brings it into position on the sealing surfaces. Achieved hereby is that the separating location 26 is closed off in a gastight manner prior to the encountering of the projectile seal.

The entire trigger mechanism is encapsulated, so that neither at a closed nor at an opened pivoting projectile loading chamber 1 can any dirt penetrate into the firing or trigger mechanism. The remaining structural components are inventively so configured in an advantageous manner, that dirt cannot adversely influence their functioning.

For the removal of the firing pin 21, at a outwardly pivoted projectile loading chamber, there is screwed out the closure screw 36 and the threaded bolt 37 is displaced by a certain extent. Thereafter, the firing pin 21 can be taken out and cleaned. When the entire firing or trigger mechanism is to be serviced, then the entire base section 38 is removed, for which there must be unscrewed any applicable screws. After the pulling out of the trigger shaft 11, there can be disassembled all parts of the trigger mechanism.

Figure 8:
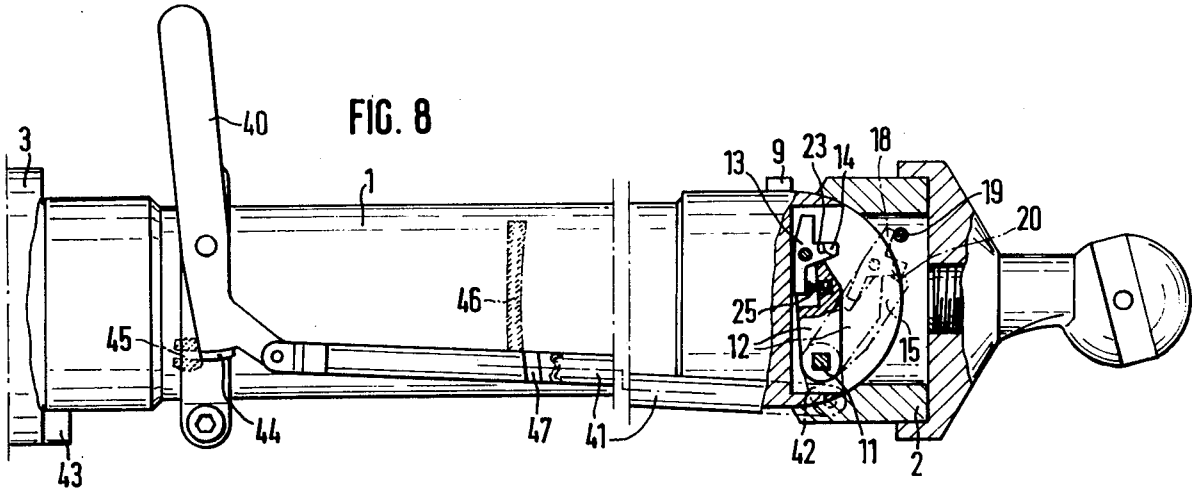
FIG. 8 illustrates a modified embodiment of the pivoting projectile loading chamber incorporating another locking construction, shown partly in section.
Figure 9:
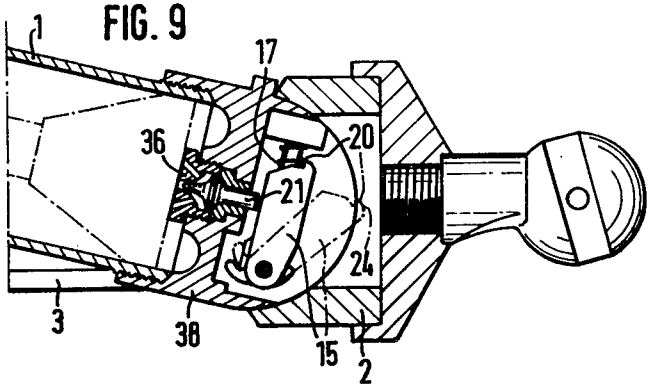
FIG. 9 illustrates a sectional view through the pivoting projectile loading chamber of FIG. 8, similar to the view taken along line II—II in FIG. 7.

A constructive modification of this inventive and above described subject matter is illustrated in FIGS. 8 and 9. Hereby, there is concurrently actuated the trigger mechanism and a projectile fired by the locking lever 40. By means of the locking lever 40 there is thus carried out the opening and the closing of the pivoting projectile loading chamber 1, the exact alignment between the firing tube 4 and the pivoting projectile loading chamber 1, as well as the firing of the shot. Also, in this instance, through the intermediary of a limit stop 9 is there prevented during the opening of the pivoting projectile loading chamber 1 the assumption of an impermissibly large opening angle.

For the triggering of the shot, the central locking lever 40 is pressed downwardly. As a result, by means of the rod 41 and the lever 42, there is rotated the trigger shaft 11, and the follower 12 is pivoted downwardly. The lever 12 which is rotatably supported at the leading end takes along the rotatable striker member 15 by means of the laterally protruding projection 14, and tensions the spring 17 by means of the extension 16 which is located on the striker member 15. When the arm 18 of the lever 13 has reached the limit stop 19, then upon further rotation of the follower 12 it is outwardly such that the prdjection 14 will slide off from the sharp edge 20 of the rotatable striker member 15 and thereby release the striker member 15. Then, due to the action of the spring 17, it will strike against the firing pin 21 and thereby initiate the firing. Through the second extention on the pressure member 22, the striker member 15 is again pivoted back into its initial starting position. During the pivoting back of the follower 12, the projection 14 on the lever 13 slides over the inclines 23 and 24 past the sharp edge 20 of the striker member 15 and thereby, responsive to the action of the spring 25, after sliding off from the sharp edge 20, is again rotated into its initial position.

After the introduction of a projectile 39 into the pivoting projectile loading chamber 1, the latter is pivoted by means of the locking lever 40 into a position where it is coaxial with the firing tube 4. Through two lateral guides which are fixed to the framework and a limit stop 43 there is achieved the coaxial alignment between the pivoting projectile loading chamber 1 and the firing tube 4. When the central locking lever 40 is now pressed downwardly for the triggering of the shot, the projection 44 on the lever slides within the groove 45 in the framework. This is only possible at an exact alignment between the firing tube and the pivoting projectile loading chamber. Consequently, this will preclude any firing at an inadequate alignment. Through the rod 41 and the lever 42 there is actuated the firing pin 21. After the shot, through lifting of the locking lever 40 by means of the rod 41 and the lever 42, the follower 12 is again brought into its initial position. Through a stop 46 which is fixed to the frame and a projection 47 on the rod 41, there is prevented that the firing can be initiated with an entirely or partially open projectile loading chamber 1. Only when the pivoting projectile loading chamber 1 has reached the required coaxial position with regard to the firing tube 4, can the projection 44 slide in the groove 45 and thereby allow for the release of the trigger mechanism. Inasmuch as the trigger mechanism is only tensioned with the downward pressing of the locking lever 40, no further safety measure is required with regard to any undesirable triggering or firing.

Particularly from FIG. 1 can there be ascertained that the operating personnel can load the weapon with an outwardly pivoted projectile chamber while fully protected. The situation which is also demonstrated in this figure for the case of a projectile chamber which is not outwardly pivotable, clearly shows that the operating personnel can implement a loading of the mortar with an elongated firing tube only with auxiliary aids and by leaving the protective environment.

We claim:

1. A pivoting projectile loading chamber for high angle-firing weapons possessing firing tubes, said loading chamber being roller-shaped at a lower end thereof; a base member of said weapon supporting said loading chamber for pivoting movement about said lower end, said loading chamber having an upper end pivotable from a position extending coaxially with the firing tube of said weapon to an outwardly displaced position; a gas pressure-controlled sealing ring for sealing an upper separating plane between the firing tube and the projectile loading chamber; locking lever means arranged in the upper region of the pivoting projectile loading chamber; locking means on the framework of the weapon and trigger means for the weapon being in operative connection with said locking lever; stop means for limiting the opening angle of the pivoting projectile loading chamber; an axial annular groove being formed in the separating plane of the pivoting projectile loading chamber, said sealing ring being inserted in said groove; bores in the wall of said pivoting projectile loading chamber communicating said sealing ring with the interior of said loading chamber and, in the locked position of said loading chamber, standing under the pressure of propellant gases during the firing of a projectile; said locking lever means comprises a double lever pivotably mounted on the pivoting projectile loading chamber; an angled end on said locking lever extending towards the loading chamber, an exterior portion of said locking lever, upon said projectile loading chamber being opened, extending along an inner curve of the locking means which is fastened to the framework, and an inner portion of said locking lever, upon said projectile loading chamber being closed, being in contact with an outer curve of the locking means which is fastened to said framework.

2. A pivoting projectile loading chamber as claimed in claim 1, wherein the locking lever means includes a projection at an end thereof facing towards the loading chamber which, at a closed pivoting projectile loading chamber, engages into a groove in the locking means which is fastened to the framework.

3. A pivoting projectile loading chamber as claimed in claim 1, wherein said trigger means includes a trigger lever in the lower region of the pivoting projectile loading chamber and being oepratively connected to said locking lever means, said trigger lever being actuatable only in dependence upon the locked position of the locking lever means; and striker member being moved by said trigger lever against a firing pin through the rotation of a trigger shaft.

4. A pivoting projectile loading chamber as claimed in claim 1, wherein said trigger means comprises a rod having one end directly connected to said locking lever means, and said rod having a lever at a second end thereof for moving a striker member against a firing pin through the rotation of a trigger shaft.

5. A pivoting projectile loading chamber as claimed in claim 4, wherein said rod is articulated with the locking lever means and includes a projection which releases the rod from a limit stop fastened to the frame only in the fully closed and locked condition of said chamber.

6. A pivoting projectile loading chamber as claimed in claim 4, wherein the firing pin is mechanically actuated, and said locking means is pivoted backwardly by a follower guiding an attached projection in a firing pin groove and drawing the firing pin back from the triggering position.

7. A pivoting projectile loading chamber as claimed in claim 4, wherein the firing pin is inserted centrally in a closure screw within the base of the pivoting projectile loading chamber.

8. A pivoting projectile loading chamber as claimed in claim 4, wherein a follower is fastened secured against rotation on the trigger shaft, said follower having a lever for pivoting a rotatable resiliently-biased striker member whereby upon release from a sharp edge of said follower, said member strikes back against the firing pin.

9. A pivoting projectile loading chamber as claimed in claim 8, wherein projection on the follower comes into contact with a locking pin in the base member of the mortar upon actuation of the trigger lever.

* * * * *